US009514688B2

(12) United States Patent
Asano et al.

(10) Patent No.: US 9,514,688 B2
(45) **Date of Patent: *Dec. 6, 2016**

(54) LIQUID CRYSTAL DISPLAY

(71) Applicant: SONY CORPORATION, Tokyo (JP)

(72) Inventors: Mitsuyasu Asano, Tokyo (JP); Tomohiro Nishi, Tokyo (JP); Yoshihiro Katsu, Kanagawa (JP)

(73) Assignee: SONY CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/570,872

(22) Filed: Dec. 15, 2014

(65) Prior Publication Data

US 2015/0097875 A1 Apr. 9, 2015

Related U.S. Application Data

(63) Continuation of application No. 13/030,417, filed on Feb. 18, 2011, now Pat. No. 8,933,872.

(30) Foreign Application Priority Data

Mar. 24, 2010 (JP) ..... 2010-068124

(51) Int. Cl.
*G09G 3/36* (2006.01)
*G09G 3/34* (2006.01)

(52) U.S. Cl.
CPC ..... *G09G 3/3406* (2013.01); *G09G 3/3426* (2013.01); *G09G 3/36* (2013.01);
(Continued)

(58) Field of Classification Search
None
See application file for complete search history.

(56) References Cited

U.S. PATENT DOCUMENTS 5,808,597 A * 9/1998 Onitsuka ..... G02F 1/1336 345/102
6,417,832 B1 7/2002 Skinner et al.
(Continued)

FOREIGN PATENT DOCUMENTS

JP 2001-142409 5/2001
JP 2009-157400 7/2009
(Continued)

OTHER PUBLICATIONS

Japanese Office Action issued May 21, 2013 in Patent Application No. 2010-068124.
(Continued)

*Primary Examiner* — Antonio Xavier
(74) *Attorney, Agent, or Firm* — Oblon, McClelland, Maier & Neustadt, L.L.P.

(57) ABSTRACT

A liquid crystal display includes: a light source unit that includes a light-guiding plate with a light-exit plane partitioned into emission subsections, and one or plural sides, and light sources; a liquid-crystal-display panel that includes pixels, and modulates light emitted from the light source unit, thereby performing image display; and a display control unit that includes a partitioning-drive processing section generating each of a light-emission pattern signal and a partitioning-drive image signal, performs light-emission driving for each light source, and performs display driving for each pixel. The partitioning-drive processing section performs a gain correction of multiplying each pixel signal in the input image signal by a predetermined gain factor that is set so that a value increases as a pixel position of the pixel signal goes away from the light source, and generates the light-emission pattern signal and the partitioning-drive image signal, by using gain-corrected pixel signal.

19 Claims, 13 Drawing Sheets

(52) U.S. Cl.
CPC ..... *G09G 2320/0233* (2013.01); *G09G 2320/0271* (2013.01); *G09G 2320/0646* (2013.01); *G09G 2360/16* (2013.01)

(56) References Cited

U.S. PATENT DOCUMENTS 6,791,566 B1 9/2004 Kuratomi et al.
7,511,696 B2 3/2009 Cernasov et al.
8,933,872 B2 * 1/2015 Asano ..... G09G 3/3426 345/102
2004/0113906 A1 6/2004 Lew et al.
2005/0078127 A1 * 4/2005 Kim ..... G09G 3/22 345/690
2007/0047262 A1 * 3/2007 Schardt ..... G02B 6/0096 362/623
2007/0171623 A1 * 7/2007 Zagar ..... B60K 35/00 362/23.12
2007/0222730 A1 9/2007 Kao et al.
2007/0242459 A1 * 10/2007 Nishigaki ..... G09G 3/342 362/276
2008/0129680 A1 * 6/2008 Kimura ..... G09G 3/3426 345/102
2008/0186734 A1 * 8/2008 Huang ..... G09G 3/3426 362/612
2008/0278432 A1 11/2008 Ohshima
2008/0297463 A1 12/2008 Tsuru et al.
2009/0009456 A1 * 1/2009 Ohshima ..... G09G 3/342 345/89
2009/0015755 A1 * 1/2009 Bang ..... G02B 6/0038 349/65
2010/0053066 A1 * 3/2010 Nonaka ..... G09G 3/3426 345/102
2010/0066752 A1 3/2010 Watanuki
2010/0149224 A1 * 6/2010 Baba ..... G09G 3/3413 345/690
2010/0194791 A1 8/2010 Ogi et al.
2010/0226536 A1 9/2010 Toji et al.
2011/0057967 A1 * 3/2011 Adachi ..... G09G 3/006 345/690
2011/0221788 A1 9/2011 Asano et al.
2011/0234478 A1 * 9/2011 Asano ..... G09G 3/3426 345/87
2011/0249178 A1 10/2011 Asano et al.
2011/0254873 A1 10/2011 Asano et al.
2011/0285611 A1 11/2011 Asano et al.
2011/0285762 A1 11/2011 Asano et al.

FOREIGN PATENT DOCUMENTS

JP 2010-54839 A 3/2010
WO WO 2009122849 A1 * 10/2009 ..... G09G 3/006

OTHER PUBLICATIONS

Office Action issued Aug. 1, 2013 in Japanese Patent Application No. 2010-068124.
Combined Chinese Office Action and Search Report issued Jun. 4, 2014 in Patent Application No. 201110068669.0 with English Translation.

* cited by examiner

LIQUID CRYSTAL DISPLAY

CROSS-REFERENCE TO RELATED APPLICATIONS

This application is a continuation of U.S. patent application Ser. No. 13/030,417, filed Feb. 18, 2011, which contains subject matter related to that disclosed in Japanese Priority Patent Application JP 2010-068124 filed in the Japan Patent Office on Mar. 24, 2010. The entire content of each of the foregoing applications is hereby incorporated by reference into the present application.

BACKGROUND OF THE INVENTION

1. Field of the Invention

The present invention relates to a liquid crystal display having a light source unit of the so-called edge light type.

2. Description of the Related Art

In recent years, as a display of a portable terminal device, an active matrix type of liquid crystal display (LCD) in which a TFT (Thin Film Transistor) is provided for each pixel has been often used. In such a liquid crystal display, generally, each pixel is driven by line-sequentially writing an image signal in an auxiliary capacitive element and a liquid crystal element of each pixel from an upper part to a lower part of a screen.

As a backlight used in the liquid crystal display, a backlight using a cold cathode fluorescent lamp (CCFL) as a light source is mainstream, but in recent years, a backlight using a light emitting diode (LED) has also appeared (for example, see Japanese Unexamined Patent Application Publication No. 2009-157400).

In the liquid crystal display that employs such an LED as a backlight, there has been proposed one in which a light source unit is configured by being divided into two or more emission subsections, and performs light-emission operation independently on this emission subsection basis (for example, see Japanese Unexamined Patent Application Publication No. 2001-142409).

SUMMARY OF THE INVENTION

Incidentally, in recent years, in order to make the entire liquid crystal display thinner, adoption of the so-called edge light type of backlight in place of the so-called direct-lighting backlight in the past has begun (for example, see Japanese Unexamined Patent Application Publication No. 2009-157400). In this edge light type of backlight, light sources such as LEDs are located at a side of a light-guiding plate, and a light-exit plane is formed on the light-guiding plate.

This edge light type of backlight is designed, generally, such that when all the light sources emit the light of the same emission intensity, non-uniformity in luminance in the light-exit plane does not occur if possible. Therefore, in such a case, almost no non-uniformity in display luminance occurs in a display screen as well.

However, in a case in which to a liquid crystal display using this edge light type of backlight, the partitioning-light-emission operation in the direct-lighting backlight of the past is directly applied for the purpose of achieving low power consumption, high contrast or the like, it is conceivable that the following problem may arise.

In other words, at first, when the partitioning-light-emission operation of the past is performed in the edge light type of backlight, a decrease in luminance corresponding to the distance from the light source occurs on the light-exit plane. For example, in the neighborhood of a central part of the light-exit plane far away from the light source, light-emission luminance becomes lower as compared to the neighborhood of an end part. When such a decrease in the luminance corresponding to the distance from the light source occurs, a crush in the tone occurs at the time of image display, and non-uniformity in the display luminance occurs within the display screen, resulting in a reduction of the display-image quality.

In view of the foregoing, it is desirable to provide a liquid crystal display capable of improving display-image quality, at the time of performing image display by using an edge light type of light source unit that performs partitioning-light-emission operation.

According to an embodiment of the present invention, the following liquid crystal display is provided. The liquid crystal display includes a light source unit that includes a light-guiding plate with a light-exit plane partitioned into a plurality of emission subsections which are independently controllable of each other and one or a plurality of sides, and a plurality of light sources disposed at the side. The liquid crystal display further includes a liquid-crystal-display panel that is configured to include a plurality of pixels, and modulates light emitted from the light source unit on the emission subsection basis, based on an input image signal made up of a pixel signal of each pixel, thereby performing image display. The liquid crystal display further includes a display control unit that has a partitioning-drive processing section that generates, based on the input image signal, each of a light-emission pattern signal indicating a light-emission pattern on the emission subsection basis in the light source unit and a partitioning-drive image signal. The display control unit performs light-emission driving for each light source of the light source unit by using the light-emission pattern, and also performs display driving for each pixel of the liquid-crystal-display panel by using the partitioning-drive image signal. The partitioning-drive processing section performs a gain correction of multiplying each pixel signal in the input image signal by a predetermined gain factor that is set so that a value increases as a pixel position of the pixel signal goes away from the light source. Further, the display control unit generates each of the light-emission pattern signal and the partitioning-drive image signal, by using each pixel signal after the gain correction being performed.

In the liquid crystal display according to the embodiment of the present invention, by the plurality of light sources disposed at the side of the light-guiding plate, the plurality of emission subsections capable of being controlled independently of each other are formed on the light-exit plane of the light source unit. In other words, the light source unit has an edge light type of structure that can perform partitioning-light-emission operation. Further, based on the input image signal made up of the pixel signal of each pixel, each of the light-emission pattern signal indicating the light-emission pattern on the emission subsection basis in the light source unit and the partitioning-drive image signal is generated. The light-emission driving for each light source of the light source unit is performed by using the light-emission pattern, and the display driving for each pixel of the liquid-crystal-display panel is performed by using the partitioning-drive image signal. At the time, there is performed the gain correction of multiplying each pixel signal in the input image signal by the predetermined gain factor that is set so that the value increases as the pixel position goes away from the light source, and by using each pixel signal after the gain correction being performed, each of the light-emission pattern signal and the partitioning-drive image signal is generated. As a result, in the light source unit of the edge light type that performs the partitioning-light-emission operation, a crush in the tone at the time of image display resulting from a decrease in the luminance corresponding to the distance from the light source on the light-exit plane is shrank or evaded, and non-uniformity in the display luminance within the display screen is suppressed.

According to the liquid crystal display in the embodiment of the present invention, at the time of image display by using the edge light type of light source unit that performs the partitioning-light-emission operation, there is performed the gain correction of multiplying each pixel signal in the input image signal by the predetermined gain factor that is set so that the value increases as the pixel position goes away from the light source, and each of the light-emission pattern signal and the partitioning-drive image signal is generated by using each pixel signal after the gain correction being performed. As a result, a crush in the tone at the time of image display is shrank or evaded, and non-uniformity in the display luminance within the display screen is suppressed. Therefore, when the image display is performed by using the edge light type of light source unit that carries out the partitioning-light-emission operation, it is possible to improve the display-image quality.

DETAILED DESCRIPTION OF THE PREFERRED EMBODIMENTS

An embodiment of the present invention will be described in detail with reference to the drawings. Incidentally, the description will be provided in the following order.

1. Embodiment (an example in which after a predetermined gain correction is performed for an input image signal, a light emission pattern signal and a partitioning-drive image signal are obtained)
2. Modification Modification 1 (an example in which light sources on both of a pair of opposing side faces emit light concurrently)

Modification 2 (an example in which light sources on respective two or more sides emit light concurrently according to a pixel position)

1. Embodiment

Entire Structure of Liquid Crystal Display 1

Figure 1:
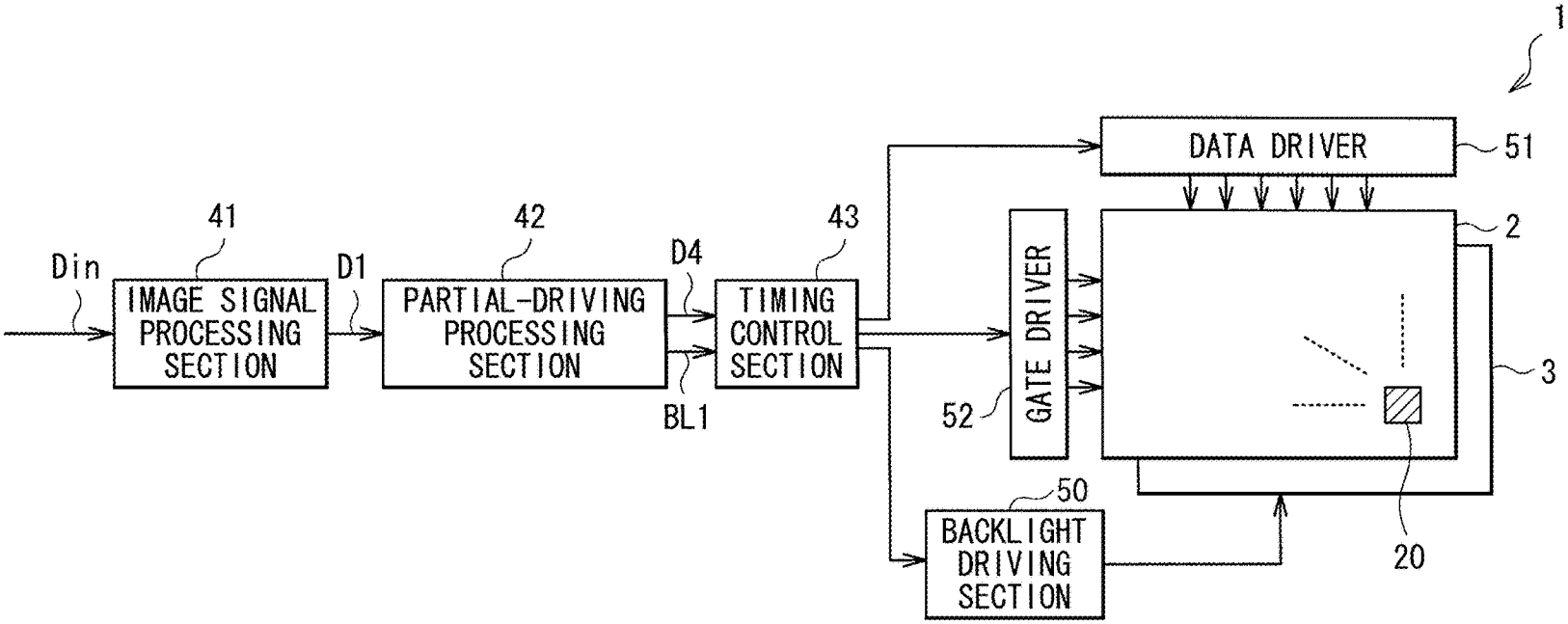
FIG. 1 is a block diagram that illustrates the entire structure of a liquid crystal display according to an embodiment of the present invention.

FIG. 1 is a block diagram of the entire liquid crystal display (liquid crystal display 1) according to an embodiment of the present invention.

The liquid crystal display 1 performs image display, based on an input image signal Din (an image signal made up of a pixel signal of each pixel 20 to be described later) input externally. The liquid crystal display 1 includes a liquid-crystal-display panel 2, a backlight 3 (light source unit), an image-signal processing section 41, a partitioning-drive processing section 42, a timing control section 43, a backlight driving section 50, a data driver 51 and a gate driver 52. Of these, the image-signal processing section 41, the partitioning-drive processing section 42, the timing control section 43, the backlight driving section 50, the data driver 51 and the gate driver 52 correspond to a specific example of the "display control unit" according to the embodiment of the present invention.

The liquid-crystal-display panel 2 performs image display based on the input image signal Din, by modulating light emitted from the backlight 3 to be described later based on the input image signal Din. This liquid-crystal-display panel 2 includes a plurality of pixels 20 arranged in the form of a matrix as a whole.

Figure 2:
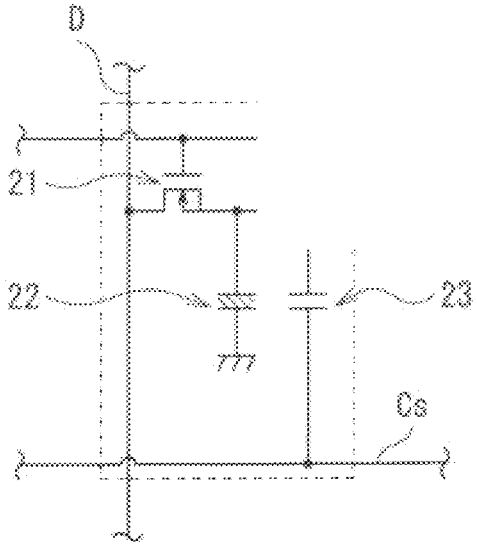
FIG. 2 is a circuit diagram that illustrates an example of the detailed structure of a pixel illustrated in FIG. 1.

FIG. 2 illustrates an example of the circuit configuration of a pixel circuit in each pixel 20. The pixel 20 has a liquid crystal element 22, a TFT element 21 and an auxiliary capacitive element 23. To this pixel 20, a gate line G for line-sequentially selecting a pixel targeted for driving, a data line D for supplying an image voltage (an image voltage supplied from the data driver 51, which will be described later) to the pixel targeted for driving, and an auxiliary capacity line Cs are connected.

The liquid crystal element 22 performs display operation, according to the image voltage supplied to one end through the TFT element 21 from the data line D. This liquid crystal element 22 is, for example, an element in which a liquid crystal layer (not illustrated) made of liquid crystal in a VA (Vertical Alignment) mode or a TN (Twisted Nematic) mode is sandwiched between a pair of electrodes (not illustrated). One (one end) of the pair of electrodes in the liquid crystal element 22 is connected to a drain of the TFT element 21 and one end of the auxiliary capacitive element 23, and the other (the other end) is grounded. The auxiliary capacitive element 23 is a capacitive element for stabilizing stored charge of the liquid crystal element 22. The one end of this auxiliary capacitive element 23 is connected to the one end of the liquid crystal element 22 and the drain of the TFT element 21, and the other end is connected to the auxiliary capacity line Cs. The TFT element 21 is a switching element for supplying an image voltage based on an image signal D1 to the one end of each of the liquid crystal element 22 and the auxiliary capacitive element 23, and is configured to include a MOS-FET (Metal Oxide Semiconductor-Field Effect Transistor). Of this TFT element 21, a gate is connected to the gate line G a source is connected to the data line D, and the drain is connected to the one end of each of the liquid crystal element 22 and the auxiliary capacitive element 23.

(Backlight 3)

The backlight 3 is a light source unit that emits light to the liquid-crystal-display panel 2, and is configured by using, for example, a CCFL or a LED as a light emitting element (light source). In the backlight 3, as will be described later, light emission driving is performed based on the contents (an image pattern) of the input image signal Din.

Figure 3A:
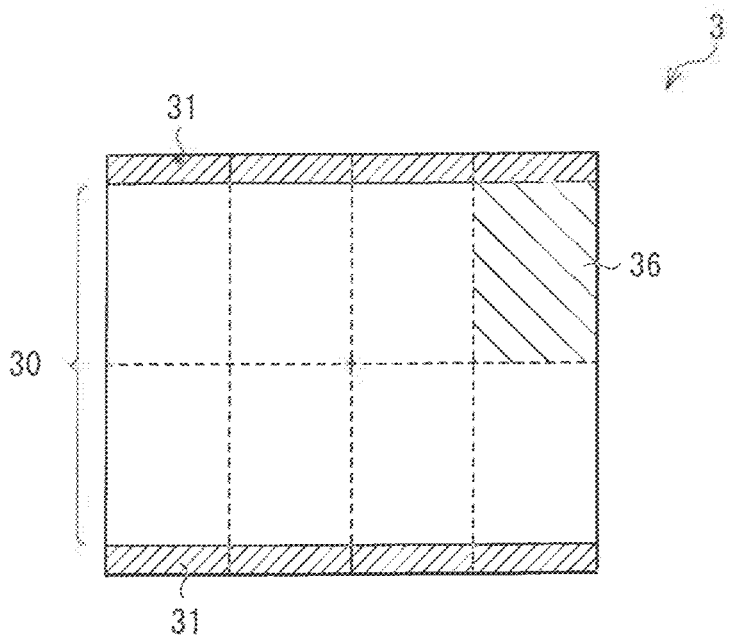
FIG. 3A and FIG. 3B are plan views that each schematically illustrate a detailed structure of a backlight illustrated in FIG. 1.
Figure 3B:
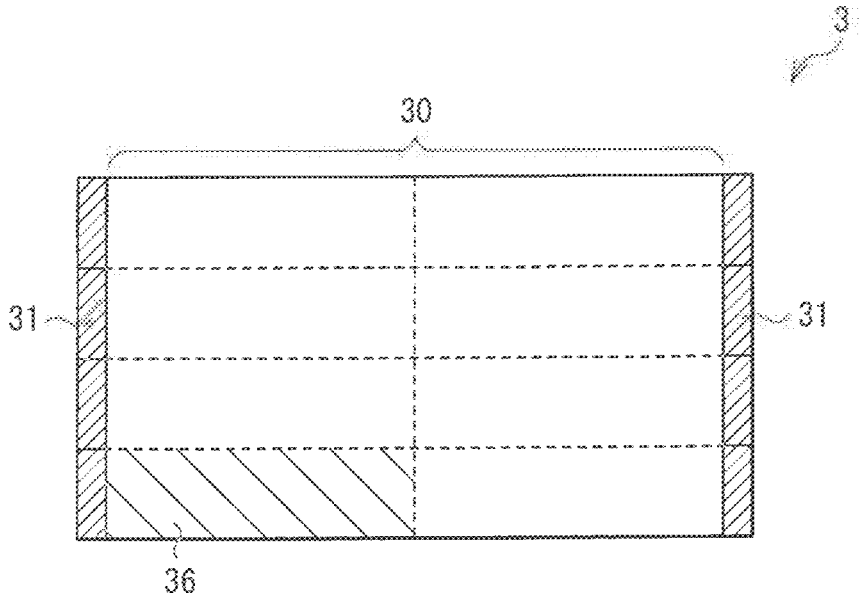

FIG. 3A and FIG. 3B schematically illustrate a detailed structure of the backlight 3 in a plan view. This backlight 3 is configured to include, for example, a rectangular light-guiding plate 30 that forms a light-exit plane, and a plurality of light sources 31 disposed at sides (sides of the light-exit plane) of this light-guiding plate 30. Specifically, in the example illustrated in FIG. 3A, a plurality of (here, four) light sources 31 are disposed on both of a pair of opposing side faces (sides in a vertical direction) in the rectangular light-guiding plate 30. Further, in the example illustrated in FIG. 3B, a plurality of (here, four) light sources 31 are disposed on both of a pair of opposing side faces (sides in a lateral direction) in the rectangular light-guiding plate 30. Incidentally, in the present embodiment, as illustrated in FIG. 3A, there will be described below the example in which the plurality of light sources 31 are disposed on both of the pair of opposing side faces (sides in the lateral direction) in the rectangular light-guiding plate 30.

Figure 4:
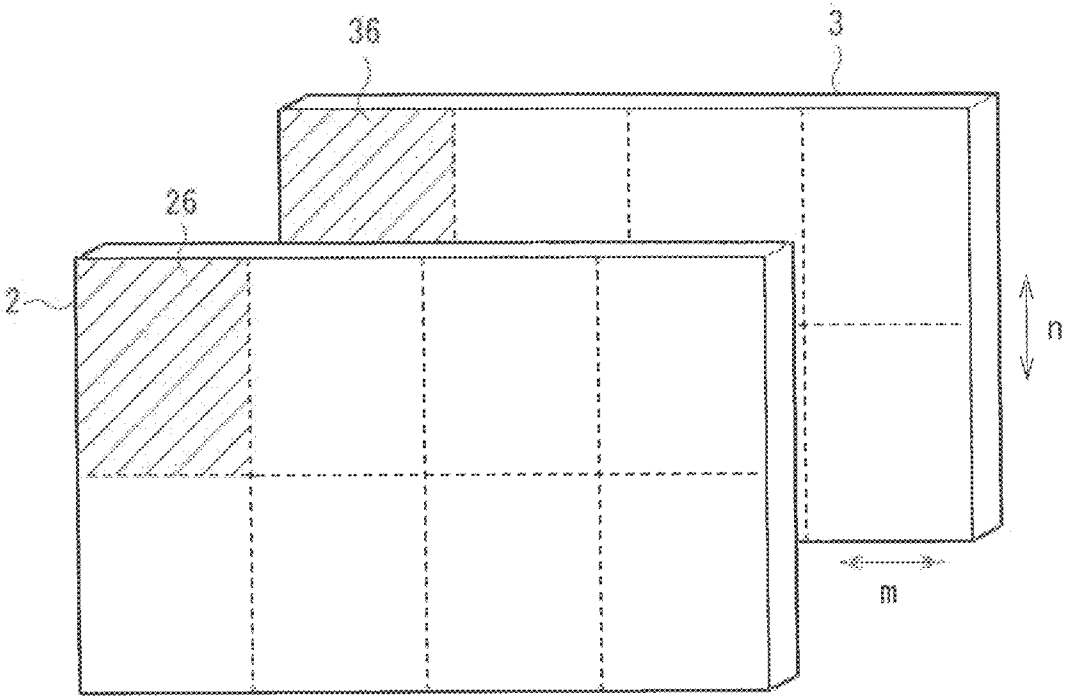
FIG. 4 is an exploded perspective view that schematically illustrates an example of a light-emission sub-region and an irradiated sub-region in the liquid crystal display illustrated in FIG. 1.

In the backlight 3 thus configured, as illustrated in, for example, FIG. 3A, FIG. 3B and FIG. 4, a plurality of light-emission sub-regions 36 (emission subsections) that can be controlled independently of each other are formed on the light-exit plane of the light-guiding plate 30. In other words, this backlight 3 is an edge light type of backlight (capable of performing partitioning-light-emission operation) in a partitioning-driving system. Specifically, on the light-exit plane in the backlight 3, the light-emission regions of n columns×m rows=K units (n, m=an integer of 2 or more) are provided by division in an in-plane direction. Incidentally, this number of divisions is set to realize a resolution lower than the pixel 20 in the liquid-crystal-display panel 2 described above. In addition, as illustrated in FIG. 4, in the liquid-crystal-display panel 2, a plurality of irradiated sub-regions 26 corresponding to the respective light-emission sub-regions 36 are formed.

This backlight 3 can control the light emission independently for each of the light-emission sub-regions 36, according to the contents (image pattern) of the input image signal Din. In addition, for example, the light source 31 in the backlight 3 can be configured, for example, by combining color LEDs of a red LED that emits red light, a green LED that emits green light and a blue LED that emits blue light. However, the type of the LED used as a light source is not limited to this, and may employ, for example, a white LED that emits white light. Incidentally, each light source 31 is configured such that at least one such light source is used.

The image-signal processing section 41 subjects the input image signal Din made up of the image signal of each pixel 20 to, for example, predetermined image processing (for example, sharpness processing, gamma correction processing and the like) for improving the image quality, thereby generating the image signal D1. Incidentally, the image signal D1 generated in this way also is made up of the pixel signal of each pixel 20, like the input image signal Din.

Figure 5:
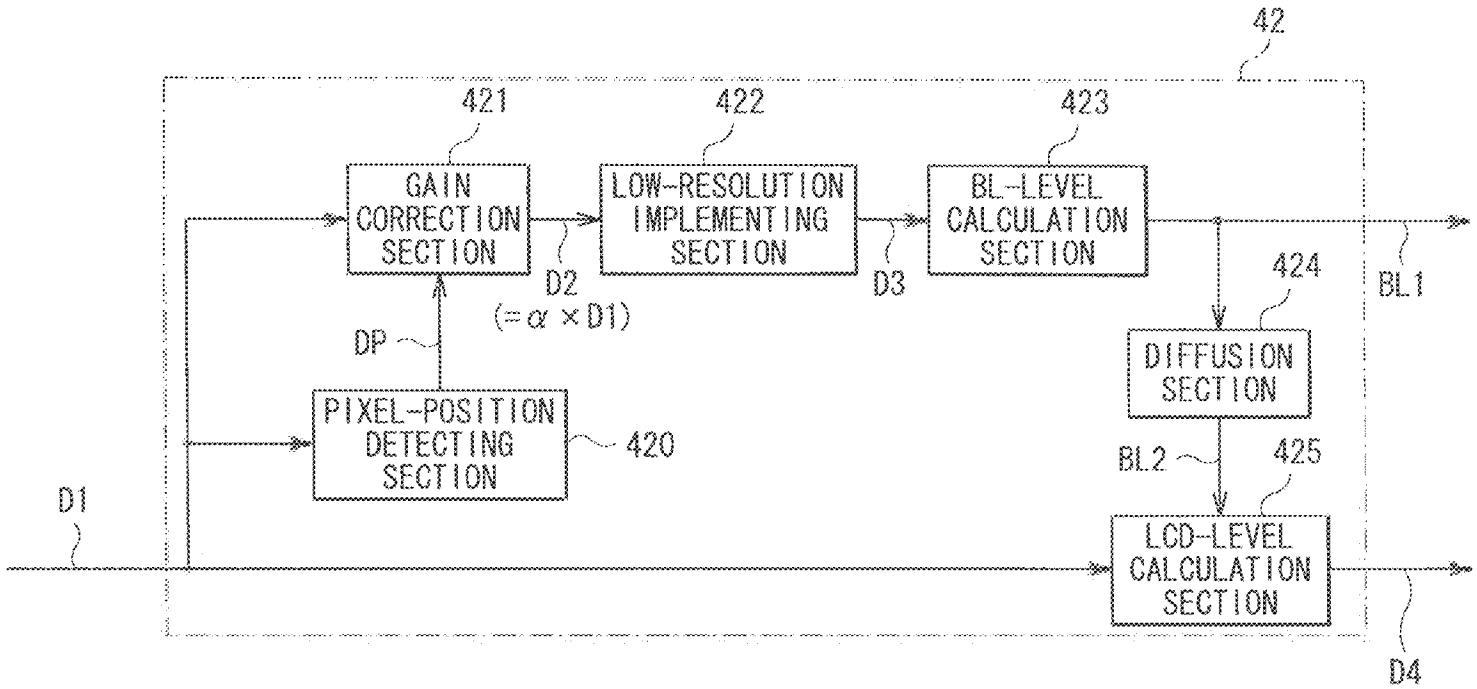
FIG. 5 is a block diagram that illustrates a detailed structure of a partitioning-drive processing section illustrated in FIG. 1.

The partitioning-drive processing section 42 subjects the image signal D1 supplied from the image-signal processing section 41, to predetermined partitioning-drive processing. As a result, the partitioning-drive processing section 42 generates each of a light-emission pattern signal BL1 indicating a light-emission pattern on the light-emission sub-region 36 basis in the backlight 3 and a partitioning-drive image signal D4. Specifically, in the present embodiment, the partitioning-drive processing section 42 performs a gain correction of multiplying each pixel signal in the image signal D1 by a predetermined gain factor $\alpha$ to be described later, and generates each of the light-emission pattern signal BL1 and the partitioning-drive image signal D4, by using each pixel signal after this gain correction is performed. Incidentally, the details of the structure of the partitioning-drive processing section 42 will be described later (FIG. 5).

The timing control section 43 controls the timing for driving the backlight driving section 50, the gate driver 52 and the data driver 51, and supplies the data driver 51 with the partitioning-drive image signal D4 supplied from the partitioning-drive processing section 42.

The gate driver 52 line-sequentially drives, according to the timing control by the timing control section 43, each pixel 20 within the liquid-crystal-display panel 2 along the gate line G described above. On the other hand, the data driver 51 supplies each pixel 20 of the liquid-crystal-display panel 2 with the image voltage based on the partitioning-drive image signal D4 supplied from the timing control section 43. Specifically, by subjecting the partitioning-drive image signal D4 to D/A (digital/analog) conversion, the image signal (the image voltage mentioned above) that is an analog signal is generated and output to each pixel 20. In this way, display driving based on the partitioning-drive image signal D4 is performed for each pixel 20 within the liquid-crystal-display panel 2.

The backlight driving section 50 performs, according to the timing control by the timing control section 43, light-emission driving (lighting driving) for each light source 31 (each light-emission sub-region 36) in the backlight 3, based on the light-emission pattern signal BL1 output from the partitioning-drive processing section 42.

[Detailed Structure of Partitioning-Drive Processing Section 42]

Next, with reference to FIG. 5, a detailed structure of the partitioning-drive processing section 42 will be described. FIG. 5 is a block diagram of the partitioning-drive processing section 42. This partitioning-drive processing section 42 includes a pixel-position detecting section 420, a gain correction section 421, a low-resolution implementing section 422, a BL-level calculation section 423, a diffusion section 424 and an LCD-level calculation section 425.

The pixel-position detecting section 420 detects the pixel position within the display screen (within the light-exit plane) of each pixel signal in the image signal D1. Incidentally, the detected pixel position of each pixel signal is output to the gain correction section 421 as position detection data DF.

The gain correction section 421 performs the gain correction by multiplying each pixel signal in the image signal D1 by the predetermined gain factor α to be described later, by using the position detection data DF supplied from the pixel-position detecting section 420. Specifically, the gain correction is performed by multiplying each pixel signal in the image signal D1 by the gain factor α (see FIG. 10A to be described later) set so that the value increases as the pixel position goes away from the light source 31 of the backlight 3. Incidentally, detailed operation of this gain correction section 421 will be described later.

The low-resolution implementing section 422 subjects a gain-corrected image signal D2 (=α×D1) supplied from the gain correction section 421 to predetermined low-resolution implementing processing, thereby generating an image signal D3 to be a basis for the light-emission pattern signal BL1 described above. Specifically, the image signal D3 is generated by reconstructing the image signal D2 configured to include a luminance-level signal (pixel signal) for each pixel 20, so that a luminance-level signal on the basis of the light-emission sub-region 36 with a resolution lower than the pixel 20 is obtained.

The BL-level calculation section 423 calculates a light-emission luminance level by the light-emission sub-region 36, based on the image signal D3 that is the luminance-level signal on the light-emission sub-region 36 basis, thereby generating the light-emission pattern signal BL1 that indicates a light-emission pattern on the light-emission sub-region 36 basis. Specifically, by analyzing the luminance level of the image signal D3 per light-emission sub-region 36, it is possible to obtain a light-emission pattern corresponding to the luminance level of each region.

The diffusion section 424 subjects the light-emission pattern signal BL1 output from the BL-level calculation section 423 to predetermined diffusion processing, thereby outputting a light-emission pattern signal BL2 after the diffusion processing to the LCD-level calculation section 425, and makes a conversion from the signal by the light-emission sub-region 36 to the signal by the pixel 20. This diffusion processing is performed by considering actual luminance distribution (diffusion distribution of light from the light source: see FIG. 8B and FIG. 10B to be described later) in the light source 31 in the backlight 3.

The LCD-level calculation section 425 generates the partitioning-drive image signal D4, based on the image signal D1 and the light-emission pattern signal BL2 after the diffusion processing. Specifically, the image signal D4 is generated by dividing the signal level of the image signal D1 by the light-emission pattern signal BL2 after the diffusion processing. To be more specific, the LCD-level calculation section 425 generates the image signal D4 by using the following equation (1) (see FIG. 9 to be described later).

$$D4=(D1/BL2) \quad (1)$$

Here, based on the above equation (1), there is obtained such a relation that the original signal (image signal D1)=(the light-emission pattern signal BL2×the partitioning-drive image signal D4). Of this, the physical meaning of (the light-emission pattern signal BL2×the partitioning-drive image signal D4) is a superimposing of a picture image of the partitioning-drive image signal D4 on a picture image of each light-emission sub-region 36 in the backlight 3 being turned on in a certain light-emission pattern. As a result, the light and shade distribution of the transmitted light in the liquid-crystal-display panel 2 is offset, which means an equivalence to the original display (display by the original signal) being viewed.

[Operation and Effect of Liquid Crystal Display 1]

Subsequently, there will be described the operation and effect of the liquid crystal display 1 of the present embodiment.

(1. Summary of Partitioning-Light-Emission Operation)

In this liquid crystal display 1, as illustrated in FIG. 1, at first, the image-signal processing section 41 generates the image signal D1 by subjecting the input image signal Din to the predetermined image processing. Subsequently, the partitioning-drive processing section 42 subjects this image signal D1 to the predetermined partitioning-drive processing. As a result, each of the light-emission pattern signal BL1 indicating the light-emission pattern on the light-emission sub-region 36 basis in the backlight 3 and the partitioning-drive image signal D4 is generated.

Subsequently, each of the partitioning-drive image signal D4 and the light-emission pattern signal BL1 generated in this way is input into the timing control section 43. Of these, the partitioning-drive image signal D4 is supplied from the timing control section 43 to the data driver 51. The data driver 51 subjects this partitioning-drive image signal D4 to the D/A conversion, thereby generating the image voltage that is an analog signal. Then, the display driving operation is performed by the drive voltage output from each of the gate driver 52 and the data driver 51 to each pixel 20. As a result, the display driving based on the partitioning-drive image signal D4 is performed for each pixel 20 in the liquid-crystal-display panel 2.

Specifically, as illustrated in FIG. 2, according to a selection signal supplied from the gate driver 52 through the gate line G, on-off operation of the TFT element 21 is switched. As a result, conduction between the data line D and the liquid crystal element 22 as well as the auxiliary capacitive element 23 is selectively performed. As a result, the image voltage based on the partitioning-drive image signal D4 supplied from the data driver 51 is supplied to the liquid crystal element 22, and the line-sequential display driving operation is performed.

On the other hand, the light-emission pattern signal BL1 is supplied from the timing control section 43 to the backlight driving section 50. The backlight driving section 50 performs the light-emission driving (partitioning-drive operation) for each light source 31 in the backlight 3 based on this light-emission pattern signal BL1. As a result, in the backlight 3, the plurality of light-emission sub-regions 36 that can be controlled independently of each other are formed on the light-exit plane, by the plurality of light sources 31 disposed at the sides of the light-guiding plate 30.

At the time, in the pixel 20 to which the image voltage is supplied, illumination light from the backlight 3 is modulated in the liquid-crystal-display panel 2, and emitted as display light. As a result, the image display based on the input image signal Din is performed in the liquid crystal display 1.

Figure 6:
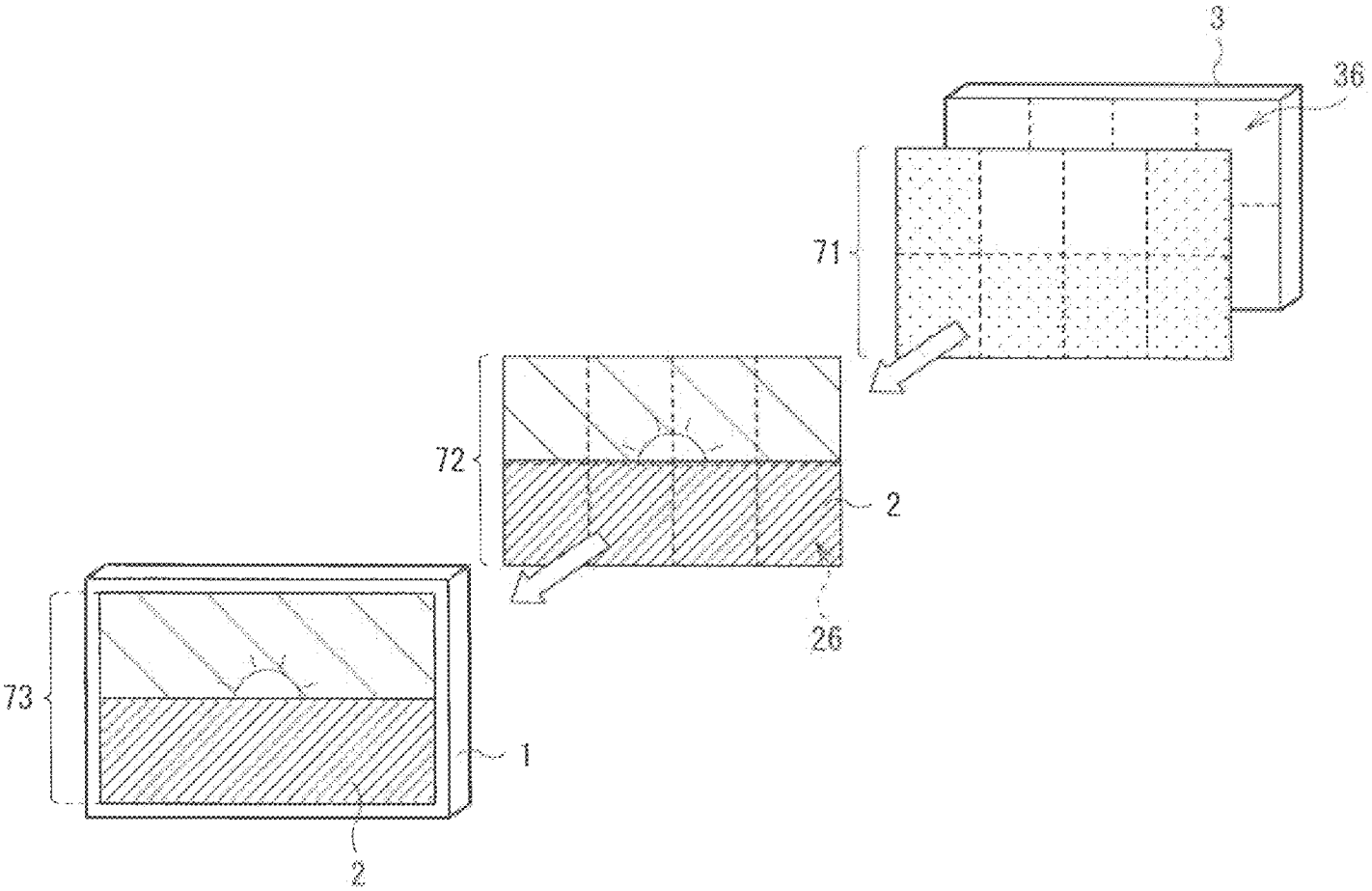
FIG. 6 is a schematic diagram that illustrates a summary of partitioning-light-emission operation of the backlight in the liquid crystal display illustrated in FIG. 1.

Specifically, as illustrated in FIG. 6, for example, a synthetic image 73 (superimposed based on multiplication), which is obtained by physically superimposing a panel-surface image 72 by the display panel 2 alone on a light-emitting surface image 71 by each light-emission region 36 of the backlight 3, becomes an image to be observed finally in the entire liquid crystal display 1.

(2. Partitioning-Light-Emission Operation Adapted to Edge Light Type of Backlight)

Next, with reference to FIG. 7 through FIG. 11B, the partitioning-light-emission operation adapted to the backlight 3 of the edge light type, which is one of features of the present invention, will be described in detail in comparison with a comparative example.

(2-1. Partitioning-Light-Emission Operation of Comparative Example)

Figure 7:
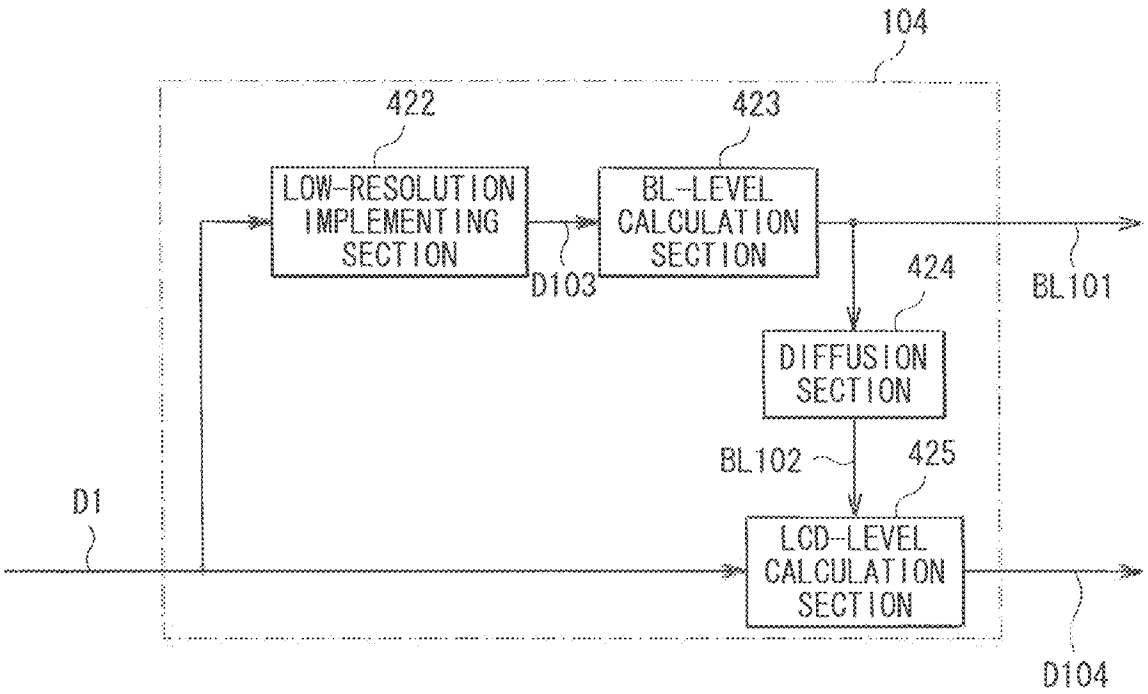
FIG. 7 is block diagram that illustrates a structure of a partitioning-drive processing section in a liquid crystal display according to a comparative example.

FIG. 7 is a block diagram of a partitioning-drive processing section (partitioning-drive processing section 104) in a liquid crystal display according to the comparative example. This partitioning-drive processing section 104 of the comparative example is configured in a manner similar to the partitioning-drive processing section 42 of the present embodiment illustrated in FIG. 5, except that the pixel-position detecting section 420 and the gain correction section 421 are omitted (prevented from being provided). In other words, this comparative example is equivalent to a case in which partitioning-light-emission operation in the (direct lighting) backlight of the past is directly applied to a liquid crystal display employing the edge light type of backlight.

Therefore, in this partitioning-drive processing section 104, at first, in the low-resolution implementing section 422, low-resolution processing is applied to the image signal D1, and an image signal D103 is generated. Subsequently, based on this image signal D103, the BL-level calculation section 423 generates a light-emission pattern signal BL101 that indicates a light-emission pattern on the light-emission sub-region 36 basis. Further, in the diffusion section 424, diffusion processing is applied to the light-emission pattern signal BL101 output from the BL-level calculation section 423, and a light-emission pattern signal BL102 after the diffusion processing is output to the LCD-level calculation section 425. Subsequently, based on the image signal D1 and the light-emission pattern signal BL102 after the diffusion processing, the LCD-level calculation section 425 generates a partitioning-drive image signal D104. Specifically, the LCD-level calculation section 425 generates the partitioning-drive image signal D104 by using the following equation (2), in a manner similar to the present embodiment.

$$D104=(D1/BL102) \quad (2)$$

Figure 8A:
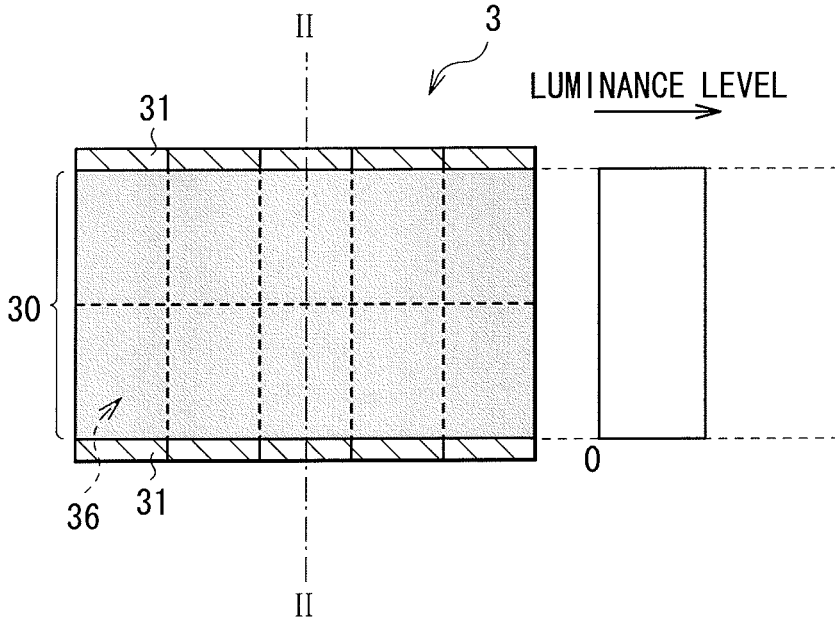
FIG. 8A and FIG. 8B are schematic diagrams for explaining a decrease in luminance corresponding to the distance from the light source on the light-exit plane of the backlight.

Here, the edge light type of backlight is designed so that, as illustrated in, for example, FIG. 8A, when all the light sources 31 emit the light of the same emission intensity, almost no luminance non-uniformity within the light-exit plane occurs if possible. Therefore, in this case, almost no display luminance non-uniformity occurs within the display screen as well. Incidentally, the luminance level at the time of light emission illustrated on the right side of the figure indicates the luminance level of each position along a line II-II on the light-exit plane of the light-guiding plate 30 in the figure. This also applies to FIG. 8B to be described below.

However, in a case in which to this liquid crystal display using the edge light type of backlight, the partitioning-light-emission operation in the (direct-lighting) backlight of the past is directly applied for the purpose of achieving low power consumption, high contrast or the like, it is conceivable that the following problem may arise.

Figure 8B:
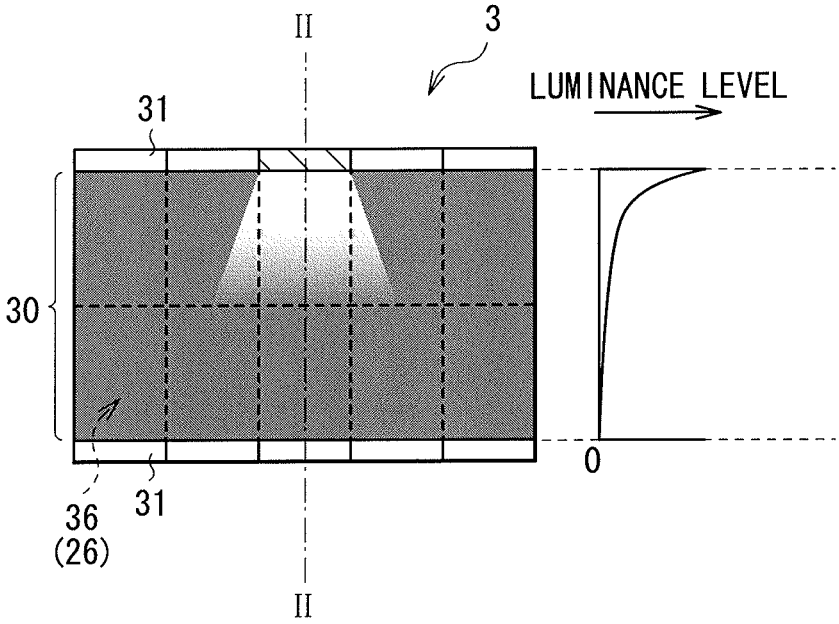

That is, first, when the partitioning-light-emission operation of the past is performed in the edge light type of backlight, as illustrated in, for example, FIG. 8B, a decrease in the luminance corresponding to the distance from the light source 31 occurs on the light-exit plane of the light-guiding plate 30. Specifically, in this example, in the neighborhood of a central part (center) of the light-exit plane and at opposite side located far away from the light source 31, the light-emission luminance is lower than that in the neighborhood of the light source 31 (the longer the distance from the light source 31 is, the lower the light-emission luminance becomes gradually).

In the backlight 3, when such a decrease in the luminance corresponding to the distance from the light source 31 occurs, a crush in the tone takes place at the time of image display, and non-uniformity in the display luminance occurs in the display screen, for the following reason. That is, as described above, the LCD-level calculation section 425 executes the division based on the above equation (2), when generating the partitioning-drive image signal D104 based on the image signal D1 and the light-emission pattern signal BL102 after the diffusion processing. In other words, the partitioning-drive image signal D104 is generated by dividing the signal level of the image signal D1 by the light-emission pattern signal BL102 after the diffusion processing.

Figure 9:
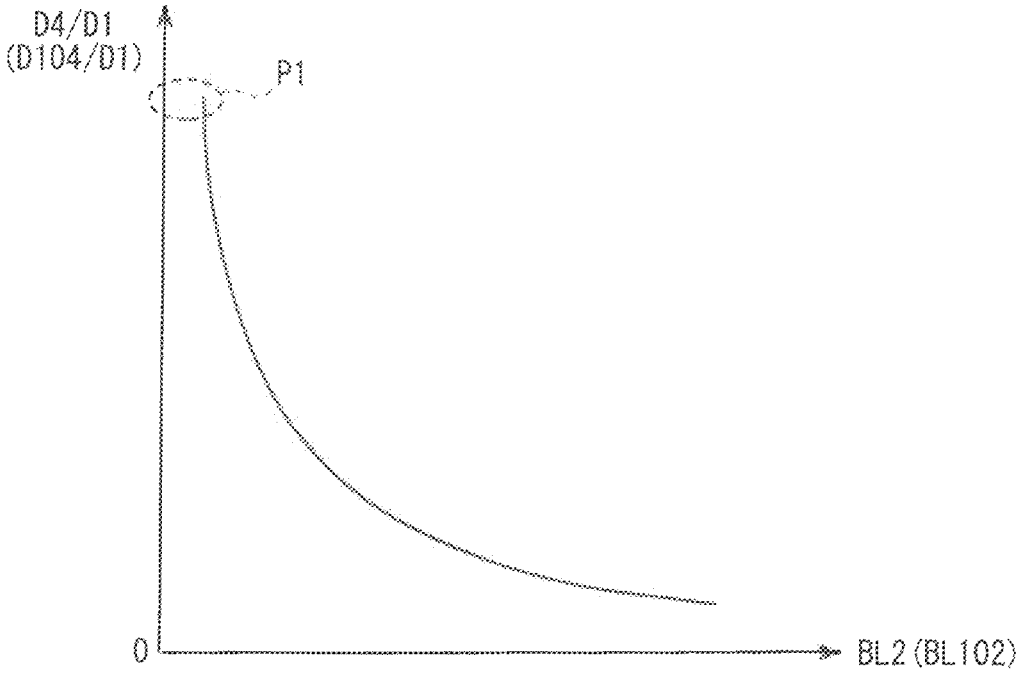
FIG. 9 is a characteristic diagram for explaining a crush in the tone at the time of display resulting from the decrease in the luminance on the light-exit plane.

For this reason, as illustrated in, for example, FIG. 9, in a case in which the luminance level in the light-emission pattern signal BL102 (for example, a region within the light-exit plane far away from the light source 31) is low, the luminance level of the generated image signal D104 becomes relatively higher as indicated by a sign P1 in FIG. 9, for example. However, in reality, the luminance level of this image signal D104 cannot be increased without limitation (towards infinity), and is limited to an upper limit or lower due to the characteristics and the like of the device (the liquid-crystal-display panel 2). As a result, in this comparative example, when a decrease in the luminance corresponding to the distance from the light source 31 occurs in the backlight 3 as described above, a crush in the tone occurs at the time of image display in the region (the region far away from the light source 31) where the luminance level in the light-emission pattern signal BL102 is low. When such a crush in the tone occurs, non-uniformity in the display luminance occurs in the display screen, which results in a reduction of the display-image quality.

(2-2. Partitioning-Light-Emission Operation of Present Embodiment)

Figure 10A:
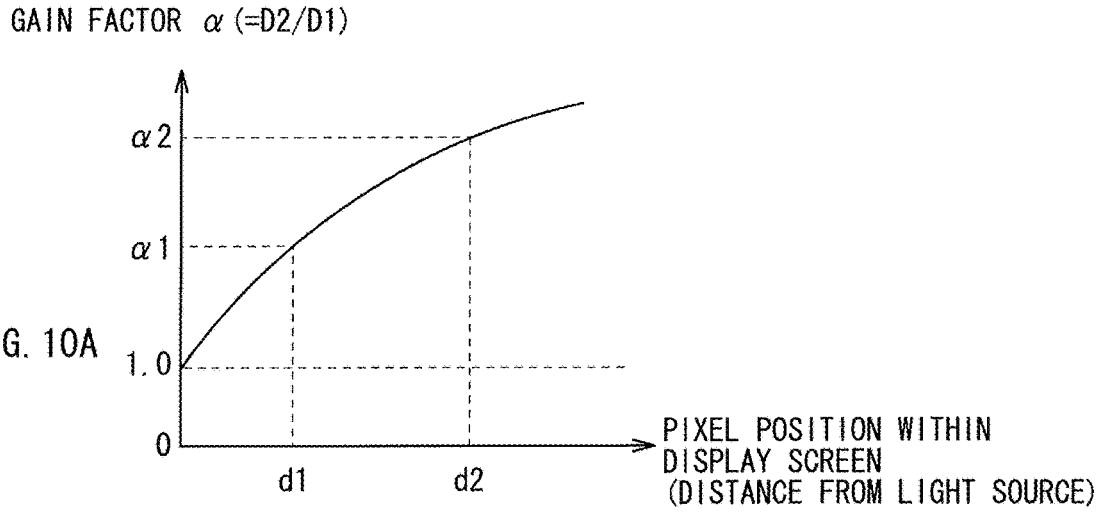
FIG. 10A and FIG. 10B are characteristic diagrams for explaining an example of gain correction operation in the liquid crystal display illustrated in FIG. 1.
Figure 10B:
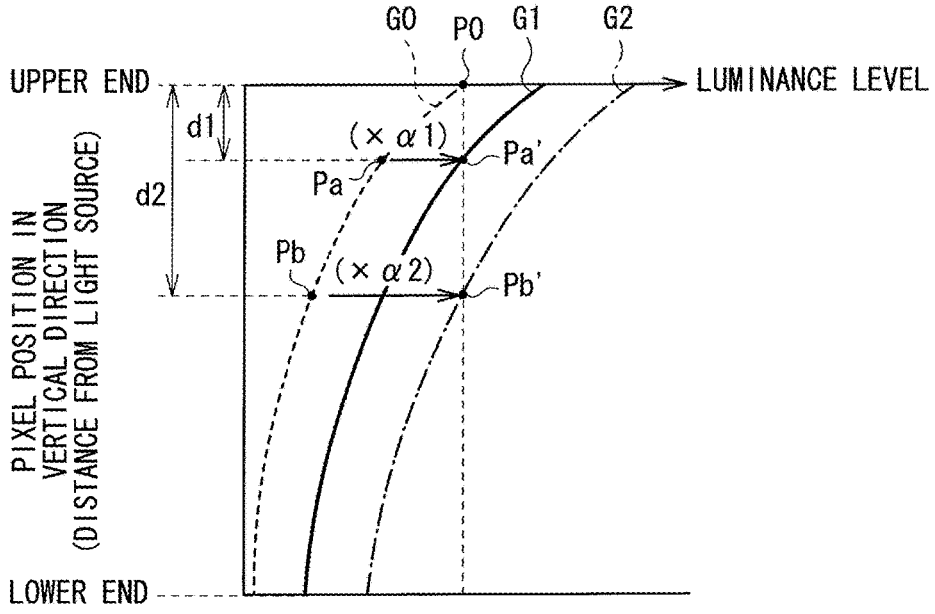

In contrast, in the present embodiment, in the gain correction section 421 of the partitioning-drive processing section 42, the gain correction is performed by multiplying each pixel signal in the image signal D1 by the predetermined gain factor α, by using the position detection data DF, thereby generating the image signal D2 (see the following equation (3)). Specifically, as illustrated in FIG. 10A, for example, the gain correction is performed by multiplying each pixel signal in the image signal D1 by the gain factor α being set so that the value increases as the pixel position goes away from the light source 31 of the backlight 3. With reference to FIG. 10A, FIG. 10B and FIG. 11, the partitioning-light-emission operation of the present embodiment using such a gain correction will be described below in detail.

$$D2=\alpha\times D1 \quad (3)$$

Figure 11A:
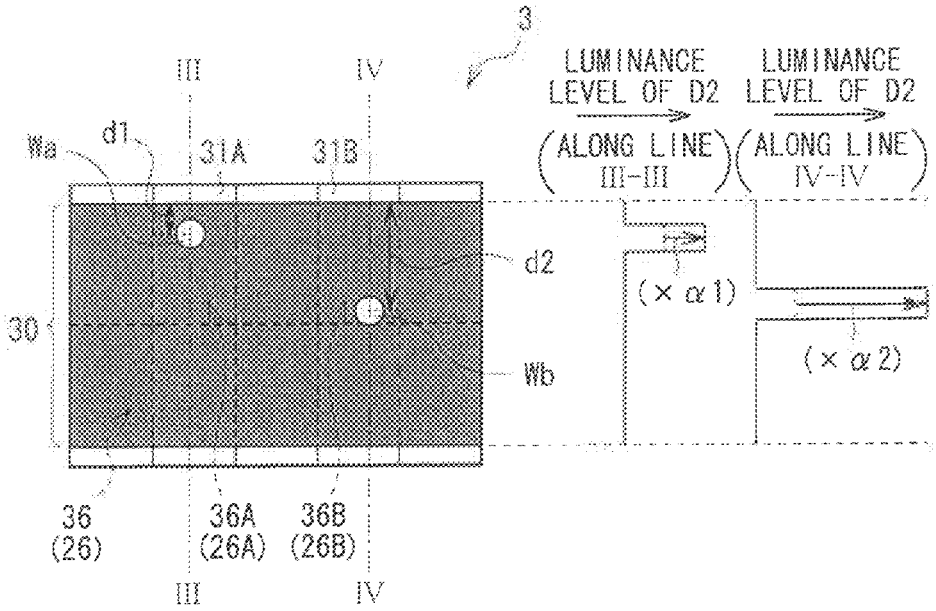
FIG. 11A and FIG. 11B are schematic diagrams that illustrate an example of the partitioning-light-emission operation using the gain correction operation illustrated in FIG. 10.
Figure 11B:
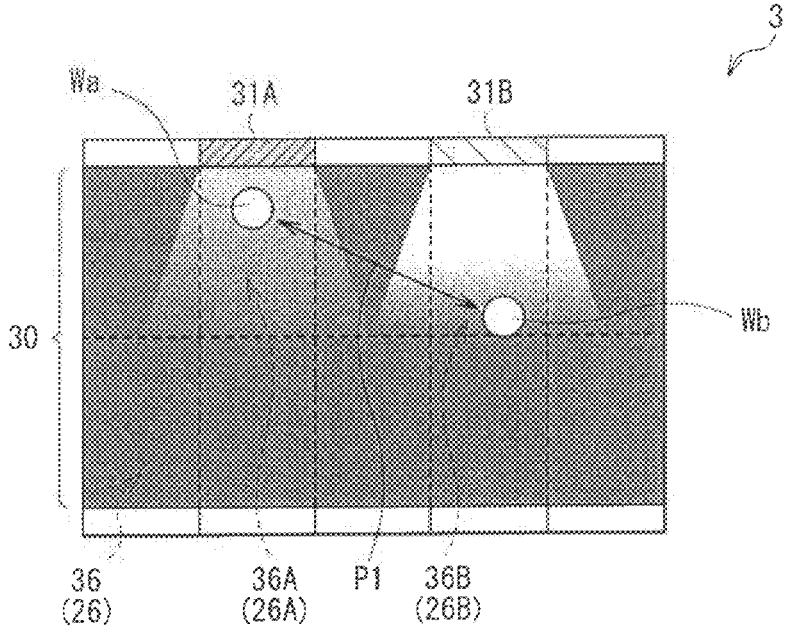

Here, FIG. 10A illustrates an example of the relation between the pixel position (the distance from the light source 31) within the screen and the value of the gain factor α. Further, FIG. 10B illustrates an example of the relation between the pixel position (the distance from the light source) in a vertical direction (V direction) within the screen and the light-emission luminance level on the light-exit plane, at the time of the gain correction, and an upper part and a lower part of the figure represent an upper end and a lower end of the screen, respectively. On the other hand, each of FIG. 11A and FIG. 11B schematically illustrates an example in which in a static image where two small bright objects (see signs Wa and Wb in the figure) exist in a background that is dark (in a gray level) as a whole, the partitioning-light-emission operation is performed by using the gain correction of the present embodiment. Incidentally, here, the pixel position of the object indicated by the sign Wa is assumed to be closer to the light source 31 on the upper side of the light-guiding plate 30 (the distance from the light source 31 is relatively short), as compared to the pixel position of the object indicated by the sign Wb. Specifically, as illustrated in FIG. 11A, a distance d1 from a light source 31A of the object indicated by the sign Wa is shorter than a distance d2 from a light source 31B of the object indicated by the sign Wb.

Therefore, in this example, at the time of the gain correction, the gain correction section 421 applies the gain factor α, as illustrated in, for example, each of FIG. 10A and FIG. 11A. In other words, it is set so that as compared to a gain factor α1 applied to the image signal D1 of the pixel position (distance d1) corresponding to the object indicated by the sign Wa, the value of a gain factor α2 applied to the image signal D1 of the pixel position (distance d2 (>d1)) corresponding to the object indicated by the sign Wb comes larger (α2>α1). Incidentally, the luminance level of the image signal D2 after the gain correction illustrated on the right side of FIG. 11A indicates the luminance level of each position along a line and a line IV-IV on the light-exit plane of the light-guiding plate 30 in FIG. 11A.

Subsequently, the BL-level calculation section 423 generates the light-emission pattern signal BL1, by using the image signal D3 based on the image signal D2 after this gain correction. Further, by using the light-emission pattern signal BL1 determined based on the image signal D2 after this gain correction, the diffusion section 424 generates the light-emission pattern signal BL2, and the LCD-level calculation section 425 generates the partitioning-drive image signal D4. Then, based on the light-emission pattern signal BL1 and the partitioning-drive image signal D4, the partitioning-light-emission operation and the display operation are performed.

Thus, in each of a light-emission sub-region 36A (irradiated region 26A) corresponding to the pixel position (distance d1) of the object indicated by the sign Wa and a light-emission sub-region 36B (irradiated region 26B) corresponding to the pixel position (distance d2) of the object indicated by the sign Wb, which are illustrated in FIG. 11A, the following partitioning-light-emission operation is performed. That is, as illustrated in, for example, FIG. 10B and FIG. 11A, light-emission driving is performed so that the light source 31B used for forming the light-emission region 36B is relatively higher in light-emission luminance level than the light source 31A used for forming the light-emission sub-region 36A.

Specifically, the light-emission luminance levels are set in the light-emission regions 36A and 36B corresponding to the objects respectively indicated by the signs Wa and Wb, so that the luminance decrease property corresponding to the distance from the light source 31, as indicated by a sign G0 in FIG. 10B, for example, is compensated. To be more specific, in this example, in the light-emission sub-region 36A (see a point Pa in FIG. 10B) corresponding to the object indicated by the sign Wa, due to the gain correction with the gain factor α1, the luminance level of a point Pa' on a luminance decrease curve indicated by a sign G1 is set. Further, in the light-emission sub-region 36B (see a point Pb in FIG. 10B) corresponding to the object indicated by the sign Wb, due to the gain correction with the gain factor α2 (>α1), the luminance level of a point Pb' on a luminance decrease curve indicated by a sign G2 is set. In other words, here, the gain correction is performed so that the luminance level (at a point P0 in FIG. 10B) at the pixel position in the neighborhood of the light source 31 (the upper end) and the luminance level (Pa', Pb' in FIG. 10B) after the gain correction at the pixel position of the object indicated by each of the signs Wa and Wb become approximately equal. In other words, in this example, the value of the gain factor α is set so that the luminance decrease property G0 corresponding to the distance from the light source 31 is completely compensated.

In this way, in the present embodiment, as indicated by the sign P1 in FIG. 11B, the luminance levels on the light-exit plane of the backlight 3 at the pixel positions of the objects indicated by the respective signs Wa and Wb become approximately equal. In other words, in the backlight 3 of the edge light type that performs the partitioning-light-emission operation, a decrease in the luminance corresponding to the distance from the light source 31 on the light-exit plane is shrank or evaded. As a result, unlike the above described comparative example, a crush in the tone at the time of image display, resulting from such a decrease in the luminance corresponding to the distance from the light source 31 on the light-exit plane is shrank or evaded, and non-uniformity in the display luminance within the display screen is suppressed.

As described above, in the present embodiment, at the time of the image display by using the backlight 3 of the edge light type that performs the partitioning-light-emission operation, the gain correction is performed by multiplying each pixel signal in the image signal D1 by the predetermined gain factor α being set so that the value increases as the pixel position goes away from the light source 31, and each of the light-emission pattern signal BL1 and the partitioning-drive image signal D4 is generated by using each pixel signal (the image signal D2) after this gain correction being performed. As a result, a crush in the tone at the time of image display is shrank or evaded, and non-uniformity in the display screen is suppressed. Therefore, at the time of the image display by using the backlight 3 of the edge light type that performs the partitioning-light-emission operation, it is possible to improve the display quality.

Further, as described above, non-uniformity in the display luminance within the display screen can be suppressed. Therefore, in the liquid crystal display 1 using the backlight 3 of the edge light type, even when the liquid-crystal-display panel 2 is upsized (the screen is enlarged), it is possible to apply the partitioning-light-emission operation while suppressing a decrease in the image quality to a minimum, and low power consumption and high contrast can be achieved.

2. Modification

Subsequently, modifications (modifications 1 and 2) of the foregoing embodiment will be described. Incidentally, the same elements as those of the embodiment will be provided with the same signs as those of the embodiment, and the description will be omitted as appropriate.

(Modification 1)

Figure 12:
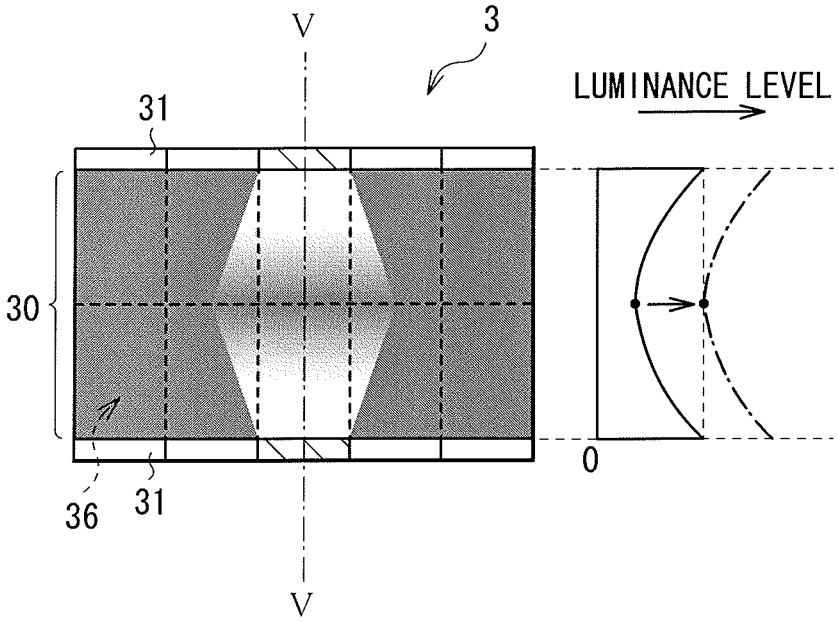
FIG. 12 is a schematic diagram that illustrates an example of partitioning-light-emission operation according to a modification 1 of the present invention.

FIG. 12 schematically illustrates an example of the partitioning-light-emission operation according to the modification 1. In the present modification, as illustrated in FIG. 12, the partitioning-light-emission operation is performed so that the light sources 31 at both of a pair of opposing side faces (here the sides in a vertical direction) in the light-guiding plate 30 emit the light concurrently. Incidentally, the luminance level at the time of light emission on the right side of the figure indicates the luminance level of each position along a line V-V on the light-exit plane of the light-guiding plate 30.

The present modification that performs such partitioning-light-emission operation also can produce an effect similar to that in the above-described embodiment, by using the gain correction in a manner similar to the above-described embodiment (see an arrow in FIG. 12). In other words, it is possible to shrink or avoid a decrease in the luminance corresponding to the distance from the light source 31 on the light-exit plane of the backlight 3, and non-uniformity in the display luminance within the display screen can be suppressed.

(Modification 2)

Figure 13A:
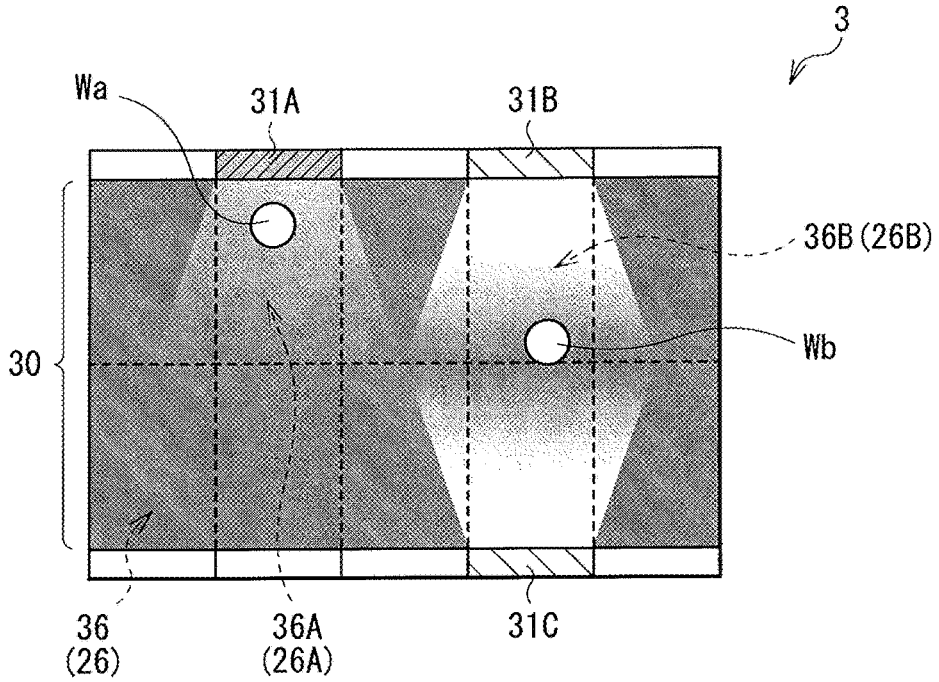
FIG. 13A and FIG. 13B are schematic diagrams that illustrate an example of partitioning-light-emission operation according to a modification 2 of the present invention.
Figure 13B:
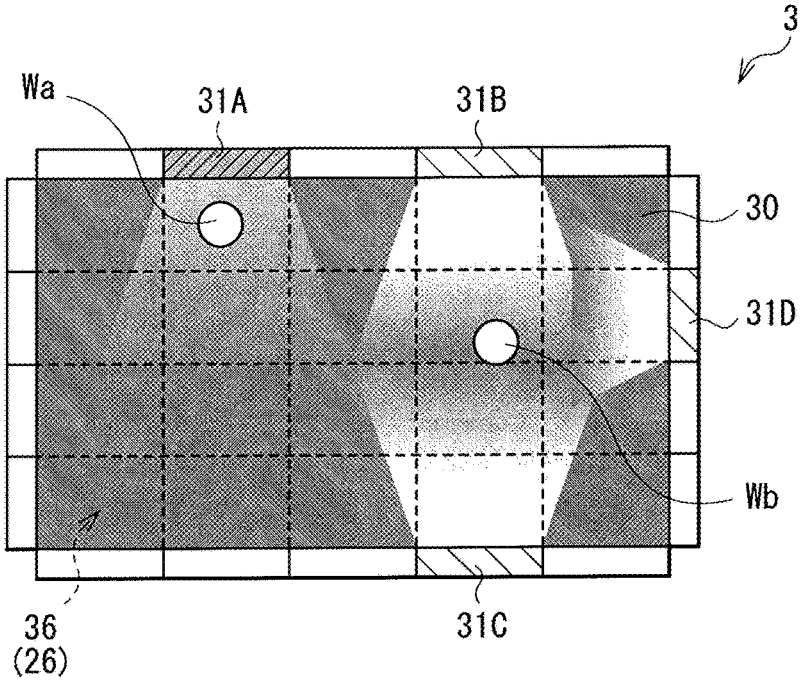

Each of FIG. 13A, and FIG. 13B schematically illustrates an example of the partitioning-light-emission operation according to the modification 2. In the present modification, the light sources 31 at each of two or more sides of the light-guiding plate 30 emit the light concurrently, according to the pixel position of a target object within the display screen.

Specifically, in the example illustrated in FIG. 13A, in addition to the light sources 31A and 31B in charge of the light-emission sub-regions 36A and 36B (irradiated sub-regions 26A and 26B) in the example illustrated in FIG. 11A and FIG. 11B, a light source 31C located at the opposite side of the light source 31A also performs the light-emission operation. In other words, here, the pixel position of the object indicated by the sign Wb is also in a position (near the middle) closer to the opposite side (the light source 31C side) to some extent and therefore, the light source 31C provided at the opposite side also performs the light-emission operation.

Furthermore, in the example illustrated in FIG. 13B, the light sources 31 are disposed at each of four sides of the light-guiding plate 30, and the light sources 31 at three or more sides of this light-guiding plate 30 emit the light concurrently. Specifically, in addition to the light sources 31A and 31B in charge of the light-emission sub-regions 36A and 36B (irradiated sub-regions 26A and 26B), the light source 31C and a light source 31D also perform the light-emission operation. This is because, here, the pixel position of the object indicated by the sign Wb is in the position also closer to the light source 31D to some extent.

In this way, in the present modification, the light sources 31 at the two or more sides in the light-guiding plate 30 emit the light concurrently, according to the pixel position of the target object within the display screen and therefore, in addition to the effect in the above-described embodiment, further suppression of the non-uniformity in display luminance within the display screen can be achieved.

Other Modifications

Up to this point, the present invention has been described by using the embodiment and the modifications, but the present invention is not limited to these embodiment and modifications, and can be variously modified.

For example, the embodiment and the like have been described for the case in which the backlight is configured to include the red LED, the green LED and the blue LED as the light sources, but the backlight may be configured to include, in addition to (or in place of) them, a light source of other color. For example, in a case in which the backlight is configured to include four or more colors, it is possible to expand the color reproduction range and express more various colors.

Further, the embodiment and the like have been described for the case in which the light-guiding plate is shaped like a rectangle, but the shape of the light-guiding plate is not limited to the rectangle, and the light source may be provided at at least one of plural sides of the light-guiding plate.

Furthermore, a series of processes described for the embodiment and the like can be executed by hardware, and also by software. In a case in which the series of processes are executed by software, the program of the software is installed on a general-purpose computer or the like. Such a program may be stored beforehand in a recording medium built in the computer.

It should be understood by those skilled in the art that various modifications, combinations, sub-combinations and alterations may occur depending on design requirements and other factors insofar as they are within the scope of the appended claims or the equivalents thereof.

What is claimed is:

1. A display apparatus comprising:

a light source unit that includes a light-guiding plate with a light-exit plane partitioned into a plurality of emission subsections which are independently controllable of each other, and one or a plurality of sides, and a plurality of light sources disposed at one or a plurality of said sides;

a display panel that includes a plurality of pixels, and is configured to adjust light emitted from the light source unit on the emission subsection basis, based on an input image signal made up of a pixel signal of each pixel, thereby performing image display; and circuitry that generates, based on the input image signal, a light-emission pattern signal indicating a light-emission pattern on the emission subsection basis in the light source unit, that performs light-emission driving for each light source of the light source unit using the light-emission pattern signal, and that performs display driving for each pixel of the display panel using a partitioning-drive image signal, wherein the circuitry performs a gain correction by multiplying each pixel signal in the input image signal by a predetermined gain factor that is set so that a value of the predetermined gain factor increases as a distance from a pixel position of the pixel signal to the light source disposed at the side increases, and so that non-uniformity in a display luminance within the display panel is suppressed, and generation of the light-emission pattern signal by using each pixel signal after the gain correction is performed, and the circuitry performs generation of the partitioning drive image signal by a calculation using a signal level of the input image signal and the light-emission pattern signal after a diffusion processing, the light-emission pattern signal is obtained by using the each pixel signal after the gain correction is performed, and the diffusion processing is performed by considering a luminance distribution in the light source unit.

2. The display apparatus according to claim 1, wherein the value of the predetermined gain factor is set so that a luminance decrease property corresponding to a distance from the light source on the light-exit plane is compensated.

3. The display apparatus according to claim 1, wherein the light sources are disposed on both of a pair of opposing side faces in the light-guiding plate, and the circuitry performs the light-emission driving so that the light sources at both of the pair of opposing side faces emit light concurrently.

4. The display apparatus according to claim 1, wherein the light sources are disposed at each of four sides in the light-guiding plate, and the circuitry performs the light-emission driving so that the light sources at three or more sides among the four sides emit light concurrently.

5. The display apparatus according to claim 1, wherein each of the light sources is a light emitting diode (LED).

6. The display apparatus according to claim 1, wherein the circuitry detects a position within the display panel of the pixel signal of each of the pixels.

7. The display apparatus according to claim 1, wherein the luminance distribution in the light source unit is a diffusion distribution of light from each of the light sources.

8. The display apparatus according to claim 1, wherein the circuitry performs the generation of the light-emission pattern signal by performing a low-resolution implementing processing after the gain correction is performed.

9. The display apparatus according to claim 8, wherein the circuitry performs the low-resolution implementing processing by reconstructing each said pixel signal after the gain correction is performed so that a luminance-level signal on the basis of the emission subsection with a resolution lower than each said pixel is obtained for each of the plurality of the emission subsections.

10. The display apparatus according to claim 1, wherein the circuitry performs the generation of the partitioning drive image signal by dividing the signal level of the input image signal by the light-emission pattern signal after the diffusion processing.

11. The display apparatus according to claim 1, wherein the display panel modulates the light emitted from the light source unit on the emission subsection basis, based on the input image signal, thereby performing the image display.

12. The display apparatus according to claim 1, wherein the display panel is a liquid crystal display panel.

13. The display apparatus according to claim 1, wherein the light source unit includes a red light source that emits red light, a green light source that emits green light, and a blue light source that emits blue light.

14. The display apparatus according to claim 13, wherein, in terms of light sources, the light source unit consists of the red light source, the green light source, and the blue light source.

15. A display apparatus comprising:

a light source unit that includes a light-guiding plate with a light-exit plane partitioned into a plurality of emission subsections which are independently controllable of each other, and one or a plurality of sides, and a plurality of light sources disposed at one or a plurality of said sides;

a display panel that includes a plurality of pixels, and is configured to adjust light emitted from the light source unit on the emission subsection basis, based on an input image signal made up of a pixel signal of each pixel, thereby performing image display; and circuitry that generates, based on the input image signal, a light-emission pattern signal indicating a light-emission pattern on the emission subsection basis in the light source unit, that performs light-emission driving for each light source of the light source unit using the light-emission pattern signal, and that performs display driving for each pixel of the display panel using a partitioning-drive image signal, wherein the circuitry performs a gain correction by multiplying each pixel signal in the input image signal by a predetermined gain factor that is set so that non-uniformity in a display luminance within the display panel is suppressed, the circuitry performs a generation of the light-emission pattern signal using each pixel signal after the gain correction is performed, and the circuitry performs a generation of the partitioning drive image signal by a calculation using a signal level of the input image signal and the light-emission pattern signal after a diffusion processing, the light-emission pattern signal is obtained by using the each pixel signal after the gain correction is performed, and the diffusion processing is performed by considering a luminance distribution in the light source unit.

16. The display apparatus according to claim 15, wherein the display panel modulates the light emitted from the light source unit on the emission subsection basis, based on the input image signal, thereby performing the image display.

17. The display apparatus according to claim 15, wherein the display panel is a liquid crystal display panel.

18. The display apparatus according to claim 15, wherein the light source unit includes a red light source that emits red light, a green light source that emits green light, and a blue light source that emits blue light.

19. The display apparatus according to claim 18, wherein, in terms of light sources, the light source unit consists of the red light source, the green light source, and the blue light source.

* * * * *